US008845123B2

(12) United States Patent
Fridley

(10) Patent No.: US 8,845,123 B2
(45) Date of Patent: Sep. 30, 2014

(54) MAGNETIC ACCESSORY MOUNTS

(71) Applicant: Defender Innovations, Inc., Round Rock, TX (US)

(72) Inventor: Steven Marlin Fridley, Round Rock, TX (US)

(73) Assignee: Defender Innovations, Inc., Round Rock, TX (US)

( * ) Notice: Subject to any disclaimer, the term of this patent is extended or adjusted under 35 U.S.C. 154(b) by 0 days.

(21) Appl. No.: 13/794,866

(22) Filed: Mar. 12, 2013

(65) Prior Publication Data

US 2013/0185979 A1 Jul. 25, 2013

Related U.S. Application Data

(63) Continuation-in-part of application No. 13/009,203, filed on Jan. 19, 2011, now Pat. No. 8,398,256.

(60) Provisional application No. 61/317,197, filed on Mar. 24, 2010.

(51) Int. Cl.
*F41G 1/35* (2006.01)
*F21V 21/096* (2006.01)

(52) U.S. Cl.
USPC ..... 362/110; 362/191; 362/398; 42/99; 42/146

(58) Field of Classification Search
CPC ..... F41A 15/00; F41G 1/30; F41G 1/35; F21L 4/00
USPC ..... 362/110, 190, 191, 398; 42/99, 113, 42/146
See application file for complete search history.

(56) References Cited

U.S. PATENT DOCUMENTS

| | | | | |
|---|---|---|---|---|
| 2,924,881 | A * | 2/1960 | Gee | 42/127 |
| 3,037,288 | A * | 6/1962 | Detrich et al. | 42/127 |
| 4,220,304 | A * | 9/1980 | Wong et al. | 248/206.5 |
| 4,506,317 | A * | 3/1985 | Duddy | 362/396 |
| 2002/0105797 | A1* | 8/2002 | Navid et al. | 362/120 |
| 2003/0090894 | A1* | 5/2003 | Cummings | 362/110 |
| 2007/0025101 | A1* | 2/2007 | Lawless | 362/110 |
| 2008/0205037 | A1* | 8/2008 | Griffin | 362/110 |

* cited by examiner

*Primary Examiner* — Laura Tso
(74) *Attorney, Agent, or Firm* — Robert L. Villhard

(57) ABSTRACT

Apparatus for mounting accessories to guns. Some embodiments provide gun mounts each including a body and a magnet to magnetically couple the mount to the gun. The bodies are shaped and dimensioned to mechanically retain the accessories (which can be flash lights). The magnets are mechanically coupled to the bodies (and can be an integral portion thereof) and cause magnetic fields. Given the shapes and dimensions of the bodies, the positions of the magnets relative to the bodies and relative to the barrels of the guns when the bodies abut the barrels, the magnetic field strengths are within a range sufficient to releasably and magnetically couple the magnets and the barrels. In some embodiments the magnetic field strengths are sufficient to limit the ranges of motion of the mounts relative to the guns during the shock created by firing the gun.

20 Claims, 11 Drawing Sheets

MAGNETIC ACCESSORY MOUNTS

CROSS-REFERENCE TO RELATED APPLICATIONS

This application is a continuation-in-part of, and claims priority to, U.S. patent application. Ser. No. 13/009,203 filed on Jan. 19, 2011 by Steven Fridley (now U.S. Pat. No. 8,398,256 issued on Mar. 19, 2013) the entirety of which is incorporated herein by reference as if set forth in full and which is a Non-Provisional application of U.S. Provisional Patent Application No. 61/317197 filed on Mar. 24, 2010 by Steven Fridley the entirety of which is incorporated herein by reference as if set forth in full. This application is also a Non-Provisional application of U.S. Provisional Patent Application No. 61/668,700 filed on Jul. 6, 2012 by Steven Fridley the entirety of which is incorporated herein as if set forth in full.

BACKGROUND

Gun users sometimes find it convenient to rapidly mount and remove accessories from their guns. For instance, at times, it might be useful to have a light producing device (hereinafter a "light") mounted on the barrel of the gun and shining in the direction toward which the gun is aimed. For instance, military personal, security officials, etc. might find themselves in a darkened environment wherein an armed confrontation might happen. Since non-combatants, other "friendly forces," etc. might be caught in that same darkened environment they face a risk of injury or death should the user of the gun fire it in their direction in the belief (because of the darkened environment) that the friendly force is a foe. In contrast, should the user of the gun hesitate in firing the gun (due to uncertainty as to the identity of the individual), the enemy combatant and/or other desired targets might escape or turn and attack.

Some gun users have therefore attempted to mount lights on their guns with limited success in dealing with such "friendly fire" scenarios. For instance, if mounting the light on the gun requires too much time, the delay in mounting the light might totally negate the advantage of having the light in the first place. In other words, while the gun user struggles with mounting the light on the gun, the desired target might flee the scene, turn on the gun user, turn on others, etc. Also, if the mounting assembly is of insufficient mechanical strength, the shock from firing the gun might cause the mounting assembly to become loose or to become separated from the gun.

SUMMARY

The following section presents a simplified summary in order to introduce some aspects of the disclosed subject matter. This summary is not an extensive overview of the disclosed subject matter, and is not intended to identify key or critical elements or to delineate the scope of such subject matter. A purpose of the summary is to present some concepts in a simplified form as a prelude to the more detailed disclosure that is presented herein.

Thus, some embodiments disclosed herein provide apparatus for mounting accessories to weapons (for instance, guns). Such embodiments provide accessory mounts wherein each includes a body and a magnet to magnetically couple the mount to the gun. The bodies are shaped and dimensioned to mechanically retain the accessories (which can be flash lights) therein. The magnets are mechanically coupled to the bodies, can be an integral portion thereof, and of course cause magnetic fields. Once selected various characteristics (for instance, the shapes and dimensions of the bodies, the positions of the magnets relative to the bodies, and the positions of the magnets relative to the barrels of the guns when the bodies abut the barrels, the magnetic field strengths) cause a magnetic forces within a range sufficient to releasably and magnetically couple the magnets and the barrels. In some embodiments the magnetic field strengths are sufficient to limit (during the shock created by firing the guns) the range of motion of the accessory mounts relative to the guns.

Some embodiments provide apparatus for mounting accessories to guns. The bodies of such accessory mounts define mounting cavities to receive the barrels of the weapons. In addition, or in the alternative, the apparatus can include a plurality of magnets positioned relative to the bodies to be adjacent to the barrels of the weapons when the apparatus are magnetically coupled to the weapons. If desired, the bodies can be shaped and dimensioned to align the accessories and the barrels of the weapons. Moreover, the bodies can define detents which can be integral parts of the bodies and which can be shaped and dimensioned to release the accessories. In some embodiments, the magnets are on the surfaces of the bodies whereas in some embodiments the magnets are in the bodies.

In the alternative, or in addition, some embodiments provide mounts to mount accessories to guns. The mounts of these embodiments include bodies shaped and dimensioned to mechanically receive the accessories and various components of the guns. The magnets are mechanically coupled to the bodies and cause magnetic fields sufficiently strong to couple the accessory mounts to the gun components.

Various embodiments provide apparatus with magnets mechanically coupled to bodies of the apparatus and which cause magnetic fields with strengths sufficient (in conjunction with the shapes and dimensions of the bodies, the positions of the magnets relative to the bodies and the positions of the magnets relative to the barrels when the bodies abut the weapons) to releasably and magnetically couple the magnets and the barrels of the weapons. The magnetic fields can also be sufficient to (in light of the geometry of the mounts and/or weapons) limit the ranges of motion of the mounts relative to the weapons during the firing of the weapons to about one quarter of an inch.

In some embodiments, the magnets are integral portions of the accessory mount bodies. Furthermore, some individual apparatus of embodiments can include pluralities of magnets. These magnets, for a given apparatus, can be arranged in one or more rows. Moreover, the rows of magnets can be positioned relative to the bodies such that one row abuts the barrel of the weapon and, for instance, another row of magnets can abut a magazine of the weapon when the body abuts the gun. In the alternative, or in addition, an air gap (whether empty or partially filed) can separate the accessory mount from the weapon.

The body of some apparatus defines accessory and weapon cavities for receiving respectively the accessories and components of the weapons. Moreover, the body of some apparatus are shaped and dimensioned to align the accessory along longitudinal axes of the weapon components. For instance, the accessory can be a flashlight to be aligned with the barrel of a gun.

Various embodiments provide apparatus for releasably attaching accessories to guns. Apparatus of the current embodiment comprise a gun assembly and an accessory assembly. The gun assembly further comprises a first body defining a mechanical attachment point shaped and dimensioned to mate with the barrel of the gun. Moreover, the gun assembly also comprises a magnet mechanically coupled to the mechanical attachment point. As to the accessory assembly, it comprises a second body and a second magnet. The second body defines a retention cavity shaped and dimensioned to receive the accessory and a detent being shaped and dimensioned to retain the accessory in the retention cavity. The second magnet is coupled to the second body. Furthermore, the first and the second magnets are positioned on respectively the first and second bodies such that when the first and second bodies abut each other the first and second magnets magnetically couple with each other with sufficient strength to withstand a shock associated with the barrel of the gun during the firing of the gun. As a result, the apparatus can releasably attach the accessory to the gun.

In some embodiments the gun assembly further comprises a third magnet and the positioning pin is made of a ferromagnetic or magnetic material. Furthermore, the third magnet and the locking pin can be positioned relative to each and can be configured to magnetically couple with each other with sufficient strength to withstand the shock associated with the barrel of the gun during the firing of the gun and can therefore retain the locking pin in the gun assembly despite that shock. In addition, or in the alternative, the first and second magnets can define, respectively, first and second generally planar surfaces such that when the first and second bodies abut each other, the first and second magnets contact each other across the first and second planar surfaces.

In some embodiments, the mechanical attachment point is shaped and dimensioned to mate with a Picattiny rail. Moreover, the first and second bodies define abutting surfaces that are approximately 1.643 inches in length. The apparatus can further comprise a positioning pin of the gun assembly which is shaped and dimensioned to lock the gun assembly at a user-selected position on the Picatinny rail. If desired, the accessory can be a light producing device. Moreover, the first and second bodies can be shaped and dimensioned to align the light with a longitudinal axis of the barrel of the gun when the second body retains the light and the apparatus is coupled to the gun. Of course, the second magnet can be one of a plurality of magnets coupled to the second body. In some embodiments, the apparatus comprise gun adaptors and accessory retainers magnetically coupled to one and other.

To the accomplishment of the foregoing and related ends, certain illustrative aspects are described herein in connection with the figures. These aspects are indicative of various ways in which the disclosed subject matter may be practiced, all of which are intended to be within the scope of the disclosed subject matter without limiting the same. Other advantages and novel features may become apparent from the following detailed disclosure when considered in conjunction with the figures.

BRIEF DESCRIPTION OF THE FIGURES

The detailed description is described with reference to the accompanying figures. In these figures, the same left-most digit(s) of reference numbers usually indicates that these reference numbers appear for the first time in this document on the same figure. The use of similar reference numbers in different figures usually indicates similar or identical items.

DETAILED DESCRIPTION

This document discloses mounts for mounting accessories to weapons and more particularly this document discloses mounts for magnetically coupling flashlights to barrels of guns.

Figure 1:
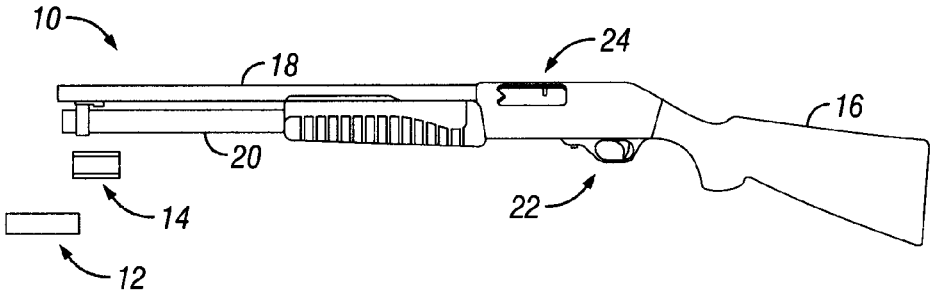
FIG. 1 illustrates a gun, an accessory mount, and a gun accessory.
Figure 2:
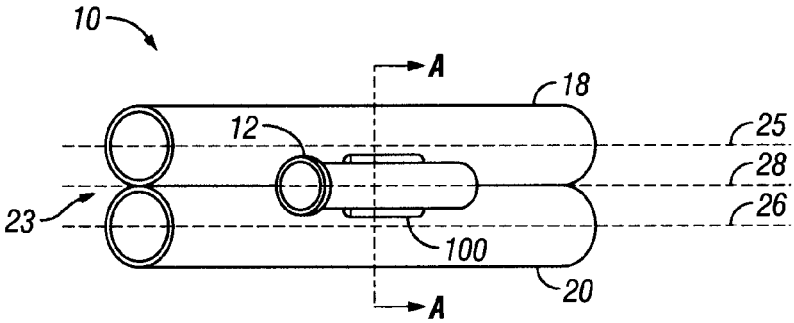
FIG. 2 illustrates an accessory mount and an accessory magnetically coupled to a gun.

FIG. 1 illustrates a gun, an accessory mount, and a gun accessory. More specifically, FIG. 1 illustrates the gun 10, a gun accessory 12 such as a light producing device, and an accessory mount 14. The gun 10 illustrated in FIG. 1 happens to be a shot gun although many other types of guns, weapons, etc, are included within the scope of the disclosure. For instance, the gun 10 could be a rifle, a semi-automatic weapon (for instance an AR-15, AK-47, an M-16, etc.), an automatic weapon, etc. With regard to the accessory 12, it can be any of a number of different accessories 12. For instance, the accessory 12 could be a light producing device (hereinafter a "light"), a gun-sight, an infrared scope, a laser sight, etc. FIG. 1 also shows the accessory mount 14 prior to it being mounted to the gun 10 and prior to receiving the accessory 12. As is discussed herein further, FIG. 2 illustrates the accessory mount 14 retaining an accessory 12 and being mounted to the gun 10. With reference again to FIG. 1, the gun 10 includes a variety of sub-assemblies and/or components such as a stock 16, a barrel 18, a magazine 20, trigger 22, and a chamber 24. Of course, other (or fewer) components could be included in the gun 10 such as for instance a second barrel (if the gun were a double-barreled shotgun).

In operation, a user might desire to shoot a target (not shown). To shoot at the target the user can brace the stock 16 against his or her shoulder, aim the barrel 18 at the target and (assuming that the gun 10 was loaded with a shell in the chamber 24) pull the trigger 22 to fire the gun 10. As the gun 10 fires, the projectile(s) accelerates through the barrel 18 and travels at a relatively high speed in the direction determined by the guidance provided to the projectile by the barrel 18. Accordingly, objects in the direction in which the barrel 18 points might be hit by the projectile.

Thus, if the area of the encounter is relatively dark, it might be desirable to attach a light to the barrel 18 to aid the user in seeing the target prior to deciding to fire the gun 10. It might, however, also be the case that the user has little time to mount the light on the barrel 18. Or it could be the case that it would be otherwise desirable to rapidly mount the light or other accessory 12 to the gun 10. More particularly, the user could use the accessory mount 14 of various embodiments to mount a light to the gun 10 by the barrel 18 (or some other component of the gun 10). To do so, the user could mount the accessory mount 14 to the barrel 18 and then couple the light to the accessory mount 14. In the alternative, or in addition, the user could couple the light and the accessory mount 14 first and then mount the accessory mount 100 to the barrel 18. Of course the user could take some other or additional course(s) of action.

Likewise, it might be the case that the user wishes to rapidly and conveniently detach the light (and/or the accessory mount 14) from the gun 10. Heretofore, mechanical assembly/disassembly of the gun 10 and the accessory mount 14 (and/or the accessory 12) was often too time consuming or inconvenient for some users. Various embodiments provide accessory mounts 14 (for accessories 12) which magnetically couple to ferromagnetic and/or ferrimagnetic components of various guns 10 and which allow for rapid (dis)assembly of the gun 10 from the accessory mount 14.

FIG. 2 illustrates an accessory mount and an accessory magnetically coupled to a gun. More particularly, FIG. 2 illustrates the accessory mount 100 with an accessory 12 retained therein and being magnetically coupled to the barrel 18 and/or magazine 20 of the gun 10. Here, it happens that both the barrel 18 and the magazine 20 are made of a ferromagnetic or ferromagnetic material and that the accessory mount 100 magnetically couples to the barrel 18 and the magazine 20 of the gun 10.

Moreover, the accessory mount 100 of the current embodiment protrudes partially into a crevice 23 defined by the barrel 18 and the magazine 20 and abuts the barrel 18 and the magazine 20. It might be worth noting that the barrel 18, the magazine 20, and the accessory mount 100 each define respective longitudinal axes 25, 26, and 28 which are generally parallel to each other in the current embodiment. Because of the parallel orientations of the barrel 18, the magazine 20, and the accessory mount 100 and the positioning of the accessory mount 100 in the crevices 23 (and its abutment to the barrel 18 and magazine 20), the accessory mount 100 tends to align itself with the direction in which the gun 10 might be aimed with little or no effort being employed by the user. Indeed, even if the accessory mount 100 becomes somewhat misaligned, the attractive magnetic force between the gun 10 and the accessory mount 100 will pull the accessory mount 100 back toward the crevices 23 thereby re-aligning the accessory mount 100 with the barrel 18 via guidance provided by the surfaces which define the crevice 23.

It might also be worth noting that since the accessory mount 100, of the current embodiment, magnetically couples to the gun 10, the accessory mount 100 generally remains coupled to the gun 10 at the position illustrated in FIG. 2 until pulled off by the user. Furthermore, if the magnet (or magnets) included in the accessory mount 100 are sufficiently strong, the magnetic coupling between the gun 10 and the accessory mount 100 can be sufficient to retain the accessory mount 100 adjacent to the gun 10 even when the accessory mount 100 happens to be mounted to the side of the barrel 18 and/or magazine 20 (which in the current embodiment are positioned one above the other). Thus, the magnetic coupling can be sufficient to prevent the weight of the accessory mount 100 (with or without the accessory 12) from pulling the accessory mount 100 away from the gun 10. In some embodiments, as is discussed further herein, the shapes and dimensions of the various portions of the accessory mount 100 can be selected to, in conjunction with the characteristics of the magnet(s), cause the foregoing and other effects.

With continuing reference to FIG. 2, it is likely that the gun 10 will generate a mechanical shock when it is fired. Heretofore, the gun 10 transmitted its firing shock to accessory mounts which had been mechanically coupled to guns 10. As a result, the mechanical attachment means of such accessory mounts tend to loosen and separate from the gun 10 after a few shots or even a single shot. Moreover, the mechanical shock transmitted to the accessory 12 also tends to break, damage, and/or degrade the accessory 12 with each firing of the gun 10.

In contrast, the magnetic coupling of the accessory mount 100 illustrated in FIG. 2 mitigates these results to a large degree if not eliminating them in their entirety. More particularly, because a magnetic field provides the coupling between the accessory mount 100 and the gun 10, mechanical shocks occurring in one will affect the other to a much less extent than as with mechanical couplings there between. Indeed, by its nature, the magnetic field will allow the accessory mount 100 to move relative to the gun 10 by an amount determined by those factors affecting the magnetic coupling between the accessory mount 100 and the gun 10. Thus, when the gun 10 fires, the mechanical firing shock will travel from the vicinity of the chamber 24 toward the location on the barrel 18 at which the accessory mount 100 is positioned. Whereupon the portion of the barrel 18 in that vicinity will accelerate and/or jerk either compressing or stretching the magnetic field in the volume between the accessory mount 100 and the barrel 18 and there about.

The distortion of the magnetic field will in turn cause the magnet of the accessory mount 100 to tend to move under the influence of the changing magnetic field. But, that movement (acceleration, jerk, etc. will be lessened by the storage of energy in the magnetic field. Therefore, since distorting a magnetic field stores energy in the magnetic field, the magnetic field decreases the shock transmitted to the accessory mount 100 while allowing a selected amount of relative movement between the accessory mount 100 and the gun 10. Again, the characteristics of the magnet(s) and the characteristics of the gun 10 and the accessory mount 100 can be selected to cause desired amounts of shock suppression, shock transmission and/or relative motion between the accessory mount 100 and the gun 10.

Figure 3:
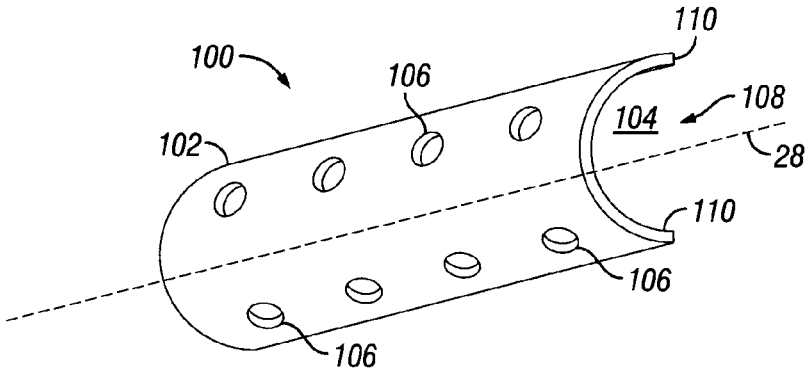
FIG. 3 is a perspective view of an accessory mount.

FIG. 3 is a perspective view of an accessory mount. The accessory mount 100 of the current embodiment can be mounted to a gun 10 and used to retain an accessory 12 as discussed with reference to FIGS. 1 and 2 and elsewhere herein. In FIG. 3 the accessory mount 100 includes a body 102 which defines an accessory cavity 104 and includes one or more magnets 106. Furthermore, the body 102 defines an aperture 108 and includes a pair of distal ends which can serve as detents 110. The accessory cavity 104 is shaped and dimensioned to receive and retain an accessory 12 such as a light (not shown). Thus, the shape and dimensions of a particular accessory cavity 104 can correspond to a particular accessory 12 or type or model thereof.

Moreover, the body 102 could define the accessory cavity 104 so that the aperture 108 opens in a direction perpendicular to the longitudinal axis 28. In some embodiments, the material of the body 102 could be resilient enough that the distal ends of the body 102 flex enough to allow the accessory 12 entry into the accessory cavity 104 while closing behind it. Thus, the accessory 12 could be pushed through the aperture 108 with the detents 110 closing behind it thereby mechanically retaining the accessory 12 in the accessory mount 100. In the alternative, or in addition, the body 102 might be shaped to receive the accessory 12 in the accessory cavity 104 from a longitudinal direction whereby the distal ends of the body 102 (that is, in the current embodiment, the detents 110) need not flex and can retain the accessory 12 in the accessory cavity 104.

FIG. 3 also illustrates that the body 102 of the accessory mount 100 can mechanically couple with the one or more magnets 106. In the embodiment illustrated by FIG. 3 the body 102 defines holes into which the magnets 106 can be placed and secured therein with an adhesive or by other means. In some embodiments though the body 102 is formed around the magnets 106 by, for instance, injection molding. However, in various embodiments, the entire body 102 could be a magnet 106 thereby simplifying some aspects of the manufacture of the accessory mount 100.

FIG. 3 also illustrates that for embodiments with more than one magnet 106 the magnets 106 can be arranged relative to one and other, and relative to the body 102, in a variety of ways. For instance, FIG. 3 illustrates that the magnets 106 can be arranged in parallel rows. As is discussed further herein with reference to FIG. 5, these rows of magnets 106 can correspond to the location of the barrel 18 and/or magazine 20 of a gun 10 (See FIGS. 1 and 2).

Figure 4:
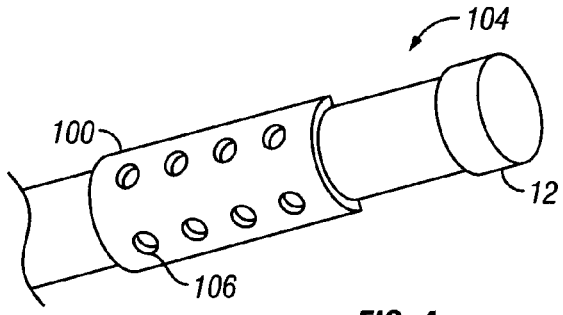
FIG. 4 is a perspective view of an accessory mount with an accessory retained therein.

FIG. 4 is a perspective view of an accessory mount with an accessory retained therein. Again, the accessory 12 is retained in the accessory cavity 104 (not shown) by the detents 110 of the body 102. And, being retained in the accessory cavity 104 (which is on the side of the accessory mount 100 opposite the side which will sometimes abut the gun 10), the accessory 12 does not interfere with the mounting of the accessory mount 100 to the gun 10. Furthermore, if the accessory 12 happens to be made of ferromagnetic or ferrimagnetic material (or might otherwise influence the magnetic fields generated by the magnets 106) the magnets 106 can be chosen to account for this factor while providing the magnetic (de)coupling capabilities (and/or the shock absorption capabilities) discussed further elsewhere herein.

Figure 5:
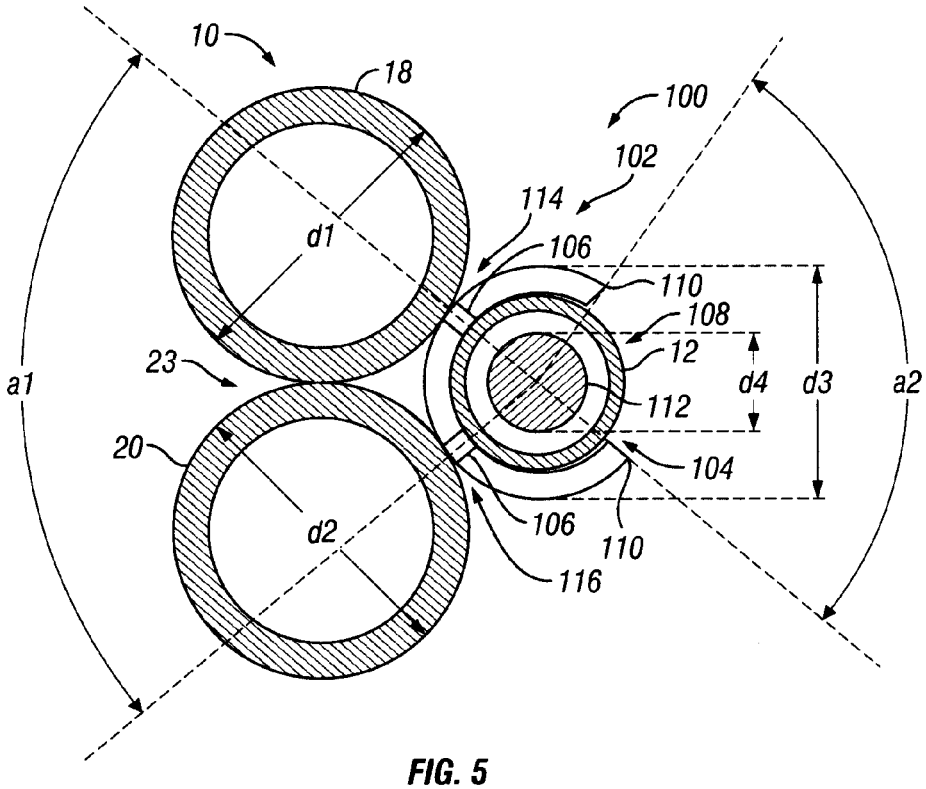
FIG. 5 is a cross-sectional view of an accessory mount magnetically coupled to a gun with an accessory retained in the accessory mount.

FIG. 5 is a cross-sectional view of an accessory mount magnetically coupled to a gun with an accessory retained in the accessory mount. More particularly, FIG. 5 illustrates a cross-sectional view of the gun 10 and an accessory mount 100 as viewed along the line AA in FIG. 2. FIG. 5 therefore illustrates the barrel 18, the magazine 20, the crevices 23, the accessory mount 100, and the accessory 12. FIG. 5 also illustrates that the accessory 12 can be a battery powered flashlight which contains one or more batteries 112 therein. While the bodies 102 of accessory mounts 100 of some embodiments can be shaped and dimensioned to hold a particular model of accessory 12 (or particular models of accessories 12) which use one of a particular battery 112 size, the bodies 102 of various other accessory mounts 100 can possess sufficient resilience (other characteristics and/or other features) to retain a variety of accessories 12 with differing dimensions, shapes, etc. Indeed, while some embodiments allow for accessories 12 powered by AA, AAA, C, D batteries 112 and/or batteries 112 of other sizes, still other embodiments allow for accessories 12 powered by other means (for instance, solar cells). Various embodiments also allow for even unpowered accessories 12.

With regard to some illustrative shapes and dimensions of the accessory mount 100 and the gun 10, it will again be noted that the accessory mount 100 of the current embodiment abuts the barrel 18 and magazine 20 of the gun 10 and is aligned in the crevices 23 there between. Moreover, the barrel 18 defines an outer diameter d1 while the magazine 20 and the accessory mount 100 define respectively, outer diameters d2 and d3. Of course, the accessory 12 can define an inner diameter d4 allowing, if desired, internal storage of one or more batteries 112. Moreover, the cross-sectional shapes (here circular) of the barrel 18, the magazine 20, and the accessory mount 100 cause the foregoing components to come into contact points 114 and 116. Since these contact points 114 and 116 define the positions on the body 102 of the accessory mount 100 which come closest to the barrel 18 and/or the magazine 20, in some embodiments, the magnets 106 are positioned in or near corresponding locations on the body 102 of the accessory mount 100. Thus, for a given combination of a particular type of gun 10 and a particular accessory mount 100 the geometry of the combination defines an angle al between the contact points 114 and 116 (and hence magnets 106) relative to the center (or other reference point) of the accessory mount 100.

In various combinations the diameters d1, d2, d3, the angle a1 (between the magnets 106), and the characteristics of the magnets 106 (such as their magnetic field strengths) can be selected to yield characteristics of the magnetic coupling between the accessory mount 100 and the gun 10. Indeed, the diameters d1, d2, and d3, the angle a1, and the magnets 106 can be selected so that the magnetic fields produce a selected static force within a desired range and shock damping within another selected range while also allowing a selected range of relative motion between the gun 10 and the accessory mount 100. Indeed, such selections can be made on a case-by-case basis, on a gun type-by-gun type basis, and/or an ammunition type-by-ammunition type basis. Note that since the ammunition type can correlate to the expected mechanical shock generated when the gun 10 fires the ammunition type can therefore have a bearing on the desired magnetic field of the magnet(s) 106.

The characteristics of the gun 10 and characteristics of the accessory mount 100 can be selected so that in some embodiments the accessory mount 100 attaches to the gun 10 by simply placing it adjacent to the barrel 18 and/or the magazine 20 while allowing the user to detach the accessory mount 100 there from by applying a selected force to separate the accessory mount 100 from the gun 10. In such embodiments the user can "slap" the accessory mount 100 to the gun 10 to attach (and align) the two objects to each other and can "rip" the accessory mount 100 off the gun 10 with quick hand movements.

Also, FIG. 5 illustrates other aspects of the appliance retention cavity 104 of the accessory mount 100. For instance, the distal ends of the body 102 (or the detents 110 as might be the case) can define an angle a2 between themselves relative to the center (or other reference point) associated with the body 102. The angle a2 could be in a range between about 90 degrees and 180 degrees although other angles a2 are within the scope of the disclosure. By selecting the angle a2 and other aspects of the body 102 (such as its material) a user can determine the retention/release capabilities of the detents 110. In some embodiments, therefore, the body 102 is made of ABS polycarbonate plastic while the angle a2 is about 130 degrees. Moreover, the magnets 206 can be selected from any type of magnets such as ceramic magnets, ferrite magnets, alnico magnets, samarium cobalt magnets, neodymium iron boron magnets, neodymium magnets, etc. In some embodiments, the magnets 106 are model number N38EH, ⅜"×⅛" NdFeB Disc Magnets available from China Rare Earth Magnets (CREM) Ltd. of ShenZhen, China.

Figure 6:
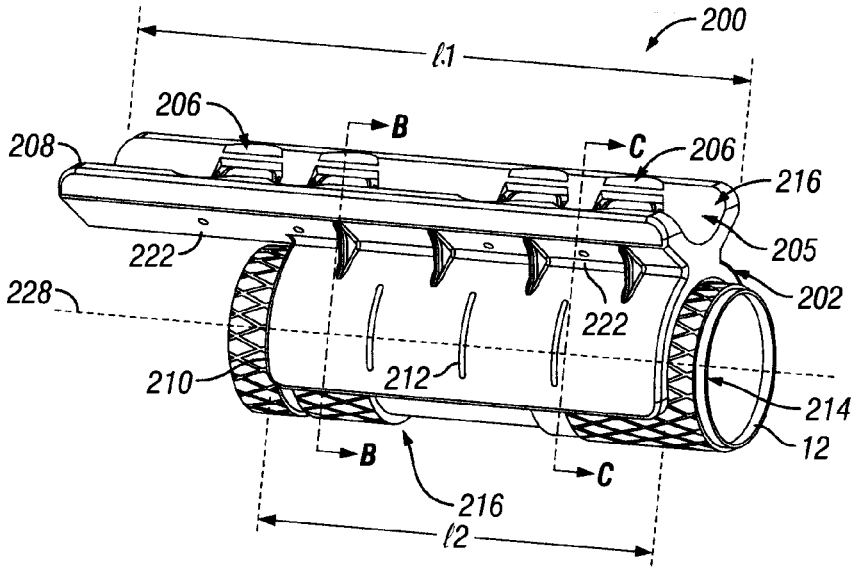
FIG. 6 is a perspective view of an accessory mount.

FIG. 6 is a perspective view of an accessory mount. The accessory mount 200 of the current embodiment can hang from underneath the barrel 18 or magazine 20 of a gun 10. Indeed, FIG. 6 illustrates the accessory mount 200 with the accessory 12 hanging from the accessory mount 200 (with the gun 10 not being present). If the gun 10 includes an extended magazine 20, the accessory mount 200 can hang from that magazine. In the alternative, or in addition, the accessory mount 200 can hang from the barrel 18 of a gun 10 without an extended magazine 20. Indeed, because of the magnetic coupling between the accessory mount 200 and the ferromagnetic and/or ferrimagnetic objects to which it can couple, the accessory mount 200 can mount to any generally cylindrical object of suitable material. Of course, the accessory mount 200 could be shaped and dimensioned to mount to objects of other shapes without departing from the scope of the disclosure.

In the current embodiment the accessory mount 200 includes a body 202, defines a weapon cavity 205, and a magnet or magnets 206. Furthermore, the body 202 of the accessory mount 200 defines a weapon portion 208 and an accessory portion 210. Various other features 212 can be included in/on the accessory mount 200 as desired. However, the accessory portion 210 can define a longitudinal axis 228 which parallels the longitudinal axis of the barrel 18 when the accessory mount 200 is mounted to the barrel 18. Therefore, provided that the weapon portion 208 and the accessory portion 210 fix the relative orientation between the barrel 18 and the accessory 12, the accessory 12 can point in the direction in which the gun 10 is aimed. The shapes and dimensions of the weapon portion 208 can be selected with regard to a type or model of gun 10 to yield desired mounting capabilities. Indeed, in some embodiments, the accessory mount 200 can rest atop the barrel 18 of the gun 10 thereby allowing the weight of the accessory mount 200 (and accessory 12 if present) to aid in pressing the accessory mount 200 and gun 10 together in lieu of or in addition to magnets 206.

Note also that the weapon portion 208 of the current embodiment defines a weapon cavity 205 with an opening 216 to allow the gun 10 (or barrel 18 thereof) to be moved into the weapon cavity 205 in a direction perpendicular to the longitudinal axis 228. However, other configurations are within the scope of the disclosure. For instance, the weapon cavity 205 could be shaped and dimensioned to allow the weapon cavity 205 to receive the barrel 18 of the gun 10 in a longitudinal direction.

With continued reference to FIG. 6, the drawing also illustrates the accessory portion 210. As is illustrated, the accessory portion 210 defines an accessory cavity (not shown due to the presence of the accessory 12). In addition, or in the alternative, in some embodiments the accessory portion 210 also includes magnets 206.

Furthermore, FIG. 6 (along with FIG. 9) illustrates that the weapon portion 208 can include two rows of four magnets 206 on its respective sides. The characteristics of the magnets 206 and the shapes and dimensions of the overall accessory mount 200 can be selected so that the magnetic coupling between the magnets 206 and the gun 10 is sufficient to retain the accessory mount 200 in abutting relationship with the gun 10 even if the accessory mount 200 were hanging from the gun 10 or otherwise oriented relative thereto.

Moreover, in the current embodiment, the shapes and dimensions of the various portions of the accessory mount 200 can be selected so as to align the accessory mount 200 (and therefore the accessory 12) with the aim of the gun 10. For instance, in embodiments wherein the gun 10 has a single barrel 18 (and no magazine 20 or other component to give rise to a crevice 23 as illustrated in FIG. 1), a length l1 of the weapon portion 208 can be selected to yield a stable mounting of the accessory mount 200 to the gun 10. In addition, or in the alternative, a length l2 of the accessory portion 210 can be selected to balance the accessory 12 in the accessory mount 200 and/or to otherwise yield a stable retention of the accessory 12 in the accessory mount 200

FIG. 6 also illustrates other features of the accessory mount 200. For instance, various features 212 could be incorporate onto accessory mounts 200 (on either the weapon portion 208 or the accessory portion 210) to aid the user in gripping the accessory mount 200 during its mounting to, or dismounting from, the gun 10. In addition, or in the alternative, such features 212 such as slits can aid in allowing the gun 10 (or perhaps the barrel 18 of the gun 10) to cool between firings. Yet other features 212 of the accessory mount 200 can provide a rugged, tough, etc. appearance. For instance, the gun mount 200 can define a slot 220 (see FIG. 9) which allows the weapon portion 208 to fit around a bayonet lug or other protrusion present on some guns 10.

Figure 7:
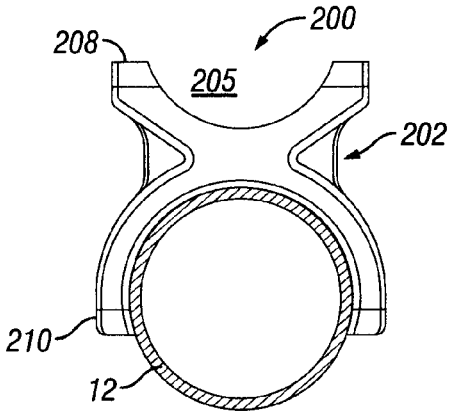
FIG. 7 is a cross-sectional view of an accessory mount.
Figure 8:
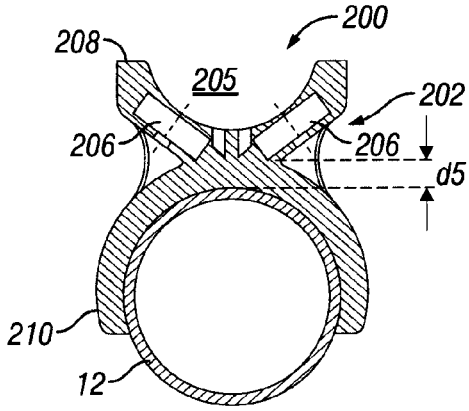
FIG. 8 is another cross-sectional view of an accessory mount.

FIG. 7 is a cross-sectional view of an accessory mount. In FIG. 7, a cross-sectional view taken along line BB of FIG. 6 and between the magnets 206 is illustrated. FIG. 8 is another cross-sectional view of an accessory mount 200. In FIG. 8, a cross-sectional view taken along line CC of FIG. 6 (at which a pair of the magnets 206 are located) is illustrated. In some embodiments, though, the magnets 206 are spaced apart from the barrel 18 of the gun 10 by some distance. Thus, the shapes and dimensions of the body 202 can be chosen to provide an air gap between the magnets 206 and the gun 10. That air gap can be filled partially or totally by the body 202 which can be made of a material chosen to increase/decrease the strength of the magnetic field of the magnets 206 therein.

In some embodiments the weapon portion 208 can define an opening through which the weapon or a portion thereof (for instance the barrel 18 of the gun 10) can be moved into the weapon cavity 205 to magnetically couple with the magnets 206. Thus, the weapon portion 208 can have a semicircular cross-section with an arc of about 180 degrees (so that the opening spans the other 180 degrees). Of course, since the magnets 206 magnetically couple with the weapon and therefore hold the weapon and the accessory mount 200 together no mechanical retention device is necessary in the current embodiment. Rather, the accessory mount 200 (and the accessory 12) hangs from the weapon and are suspended there from due to the magnetic coupling. Indeed, in some embodiments, the arc of the weapon portion 208 spans less than 180 degrees. However, if desired, the arc of the weapon portion 208 could span more than 180 degrees so that the ends thereof define detents (or other structures) to provide some mechanical capability to retain the weapon in the weapon portion 208.

Figure 9:
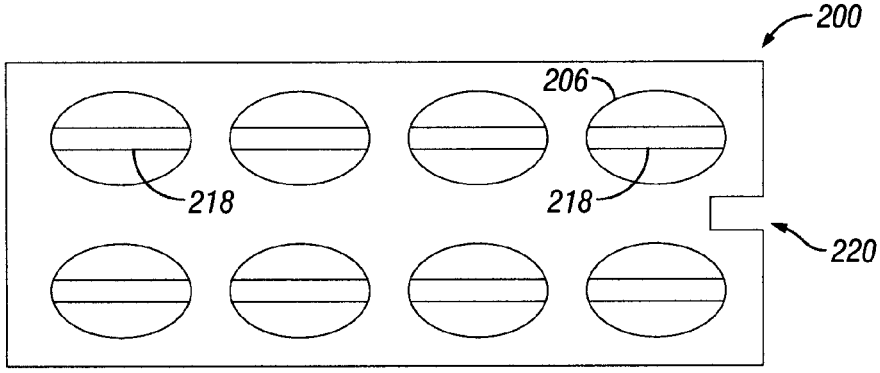
FIG. 9 is a top plan view of an accessory mount.

FIG. 9 is a top plan view of an accessory mount. In FIG. 9, two rows of magnets 206 of the accessory portion 210 are illustrated. These magnets 206 (being in relatively close proximity to the accessory cavity) can aid in retaining ferromagnetic or ferrimagnetic accessories 12 in the accessory cavity. The magnets 206 can also, via the reach of their magnetic fields, magnetically couple with the gun 10 or portions thereof to couple the accessory mount 200 and the gun 10. To that end and/or others, the weapon portion 208 can include features such as cross bars 218 to mechanically couple the magnets 206 and the accessory mount 200. The cross bars 218 can fill (either partially or completely) an air gap between the magnets 206 and the gun 10. Thus the material from which they can be fabricated can be selected so as to alter the magnetic field (and coupling) between the magnets 206 and the gun 10 as might be desired.

Figure 10:
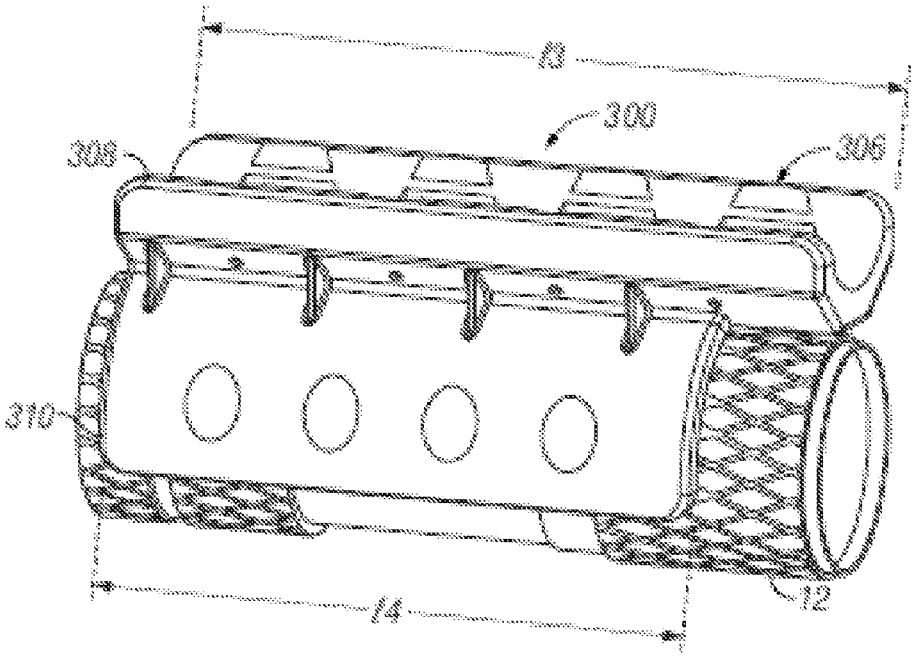
FIG. 10 is a perspective view of another accessory mount.

FIG. 10 is a perspective view of another accessory mount. The accessory mount 300 of the embodiment illustrated by FIG. 10 happens to be shaped and dimensioned to be coupled to a shotgun barrel 18. Thus, in comparison to the accessory mount 200 of FIG. 6 (which happens to be shaped and dimensioned to couple to an AR-15), the accessory mount 300 can have a weapon portion 308 with a larger interior diameter.

Moreover, the lengths l1 (see FIG. 6), l2, l3, and l4 of various gun mounts 200 and 300 can be different to accommodate conditions which might affect their mounting to various weapons. Thus, FIGS. 6 and 10 illustrate that various weapon mounts 200 and 300 can accommodate different weapon types and different accessories 12.

With reference again to FIG. 6, in some embodiments the body 202 of the accessory mount 200 is injection molded. Thus, the die in which the accessory mount 200 can be manufactured can include pins, posts, or other features to pre-position the magnets 206 in the mold. More particularly, these pins can pre-position the magnets 206 to be quite close to the weapon cavity 216 and therefore the gun 10 (when present). These pins can leave holes 222 in the body 202 at appropriate locations without departing from the scope of the disclosure. Moreover, various gate locations can be selected to facilitate the injection of a polymer, its precursor(s), or some other suitable material for such embodiments. For instance, a gate location at either the proximal or distal end of the accessory mount 202 and between the weapon portion 208 and the accessory portion 210 could be selected.

Furthermore, even though the weapon portion 208 or 308 can accommodate weapons of differing configurations, the accessory portion 210 or 310 can accommodate the same type of accessory 12. Thus, the accessory portions 210 and 310 could have the same lengths l2 (see FIG. 6) and l4 and inner diameters. However, this situation need not be the case. In some embodiments, various accessory portions 210 and 310 have different lengths l2 and l4 and inner diameters.

Moreover, other embodiments vary from one and other in other ways. For instance, the magnets 206 or 306 could be located on or in the accessory portions 210 or 310. In the alternative, or in addition, the magnets 206 and 306 could be located in or on the region of the body 202 between the weapon portions 208 and 308 and the accessory portions 210 and 310 without departing from the scope of the disclosure. Such embodiments could therefore be shaped and dimensioned in such a way as to allow the magnets 206 and 306 to magnetically couple with the accessory 12 as well as the gun 10 therefore securing both in the accessory mounts 200 and 300. It might now be helpful to consider embodiments illustrated by FIGS. 11-18.

Figure 11:
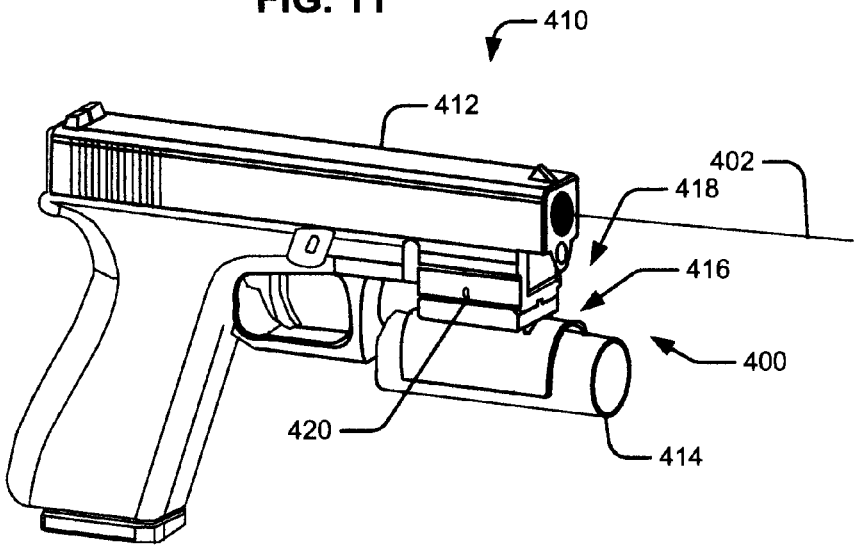
FIG. 11 is a perspective view of an accessory mount and a weapon.

FIG. 11 is a perspective view of an accessory mount and a weapon. Together with FIGS. 12-18, FIG. 11 illustrates an accessory mount 400, a weapon 410, a barrel 412, an accessory 414, an accessory adaptor 416, a weapon adaptor 418, a positioning/locking pin 420, an accessory retainer 422, an accessory cavity 424, a magnet assembly 426, magnets 428, a detent 430, an adaptor body 432, a rail cavity 434, a magnet plate 436, another magnet 438, a pin aperture 440, rail detents 442, a Picatinny rail 444, rail slots 446, and a longitudinal groove 448. Thus, generally, FIG. 11 illustrates a weapon 410 with an accessory 414 releasably attached to the barrel 412 of the weapon 410 by an accessory mount comprising the accessory adaptor 416 and the weapon adaptor 418.

As FIG. 11 illustrates, the accessory adaptor 416 (of the accessory mount 400) retains the accessory 414 and couples magnetically with the weapon adaptor 418 (of the accessory mount). The weapon adaptor, of course, therefore couples magnetically with the accessory adaptor 416 and couples mechanically with the weapon 410. Although, if desired, the weapon adaptor 418 could couple magnetically with the weapon 410 or a portion thereof such as the barrel 412, the Picatinny rail 444, and/or portions thereof. The positioning pin 420 engages both the weapon adaptor 418 and the weapon 410 to hold the weapon 410 and the accessory mount 400 in fixed positions relative to one another along a longitudinal direction (with respect to the barrel 412 of the weapon 410).

In the current embodiment, the weapon 410 happens to be a gun and, more specifically, a short-barreled gun such as a pistol. Furthermore, the weapon illustrated by FIG. 11 is an M1911 single-action, recoil operated handgun although the weapon of the current embodiment could be any type of weapon with a Picatinny rail 444. As those skilled in the art will appreciate, the weapon 410 operates by detonating a charge of powder in a cartridge of the same (or nearly the same) caliber of the barrel 412. The detonation of the charge converts the gunpowder into a mass of hot, high pressure gas which accelerates the bullet (or pellet or pellets) of the cartridge (or shell) along and out of the barrel 412. These actions along with certain others (for instance, pulling the trigger to detonate the charge) can be referred to as "firing" the weapon. Moreover, as those skilled in the art will also appreciate, firing the weapon 410 causes a shock to be imparted to the weapon 410 and/or anything that might be in mechanical communication therewith. Depending on the weapon fired, the "recoil force" (or firing shock) can be up to the order of 62.3 ft-lbs. Roughly, the recoil force varies proportionally with the caliber of the weapon although a number of factors can impact the recoil force associated with a given weapon 410. Note, though, that the accessory mount of embodiments couples directly to the barrel 412 where the recoil force can be relatively unattentuated by other components of the weapon 410.

Figure 12:
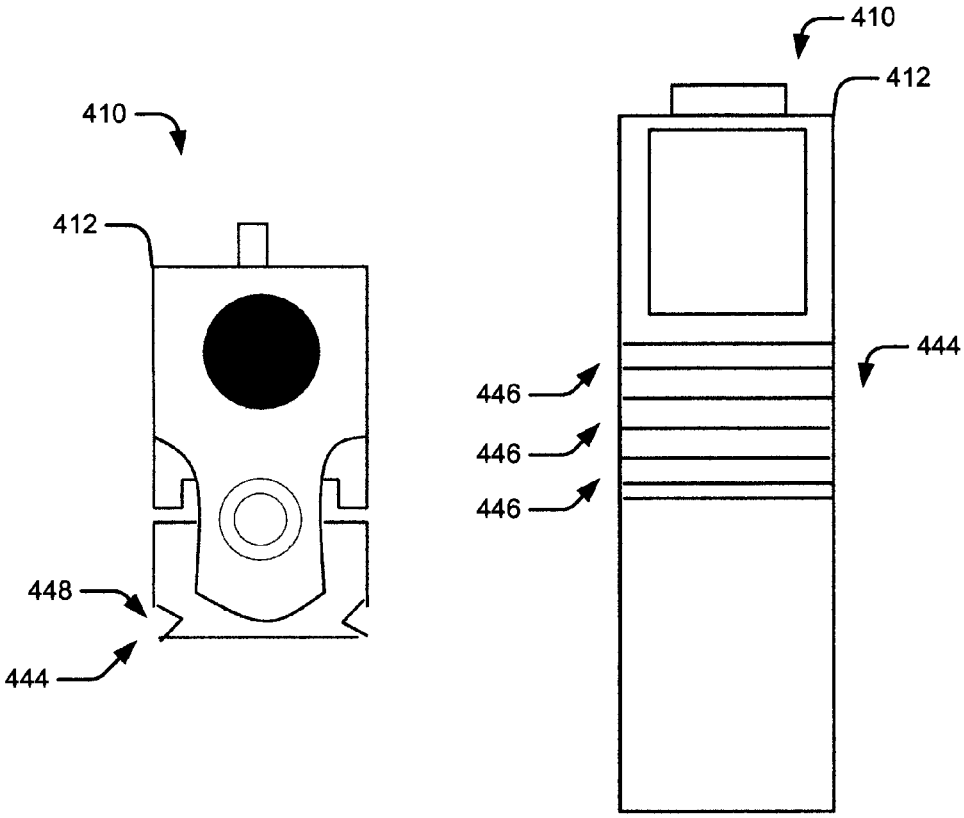
FIG. 12 illustrates a weapon.

FIG. 12 illustrates a weapon. More specifically, FIG. 12 illustrates a front elevation view of the barrel 412 (and certain other portions) of the weapon 410 and a bottom plan view of the same. Both views show the Picatinny rail 444 which some users utilize to attach various accessories to various weapons 410. To that end, the Picatinny rail 444 defines a series of rail slots 446 spaced apart from one another along some or all of the length of the barrel 412. These rail slots 446 can span the width of the barrel 412 in a direction transverse to the longitudinal axis 402 of the barrel 412. In the current embodiment, the Picattiny rail 444 also defines the longitudinal groove 448 (viewed from its end in the front elevation view of FIG. 12). Furthermore, the longitudinal groove 448 runs along at least a portion of the Picatinny rail 444. While non-limiting, some Picatinny rails 444 define rail slots 446 which are about 0.15 inches across and are separated by raised areas of the Picatinny rail 444 which are about the same distance across. For the weapon 410 illustrated by FIG. 12, moreover, the Picattiny rail 444 extends for a length of about 0.891 inches along the barrel 412 and spans its 0.815 inch width. It might now be helpful to further consider the accessory adaptor 416 of the current embodiment. It might also be worth noting that because the Picattiny rail can be formed integrally with the barrel 412 of the weapon 410, it can be considered to be a potion of the barrel 412. In addition, or in the alternative, even if the Picatinny rail 444 is an add-on or "after-market" item, it is usually firmly mechanically coupled to the barrel 412. As such, it is likely to experience and transmit much the same firing shock as does the barrel 412 itself.

Figure 13:
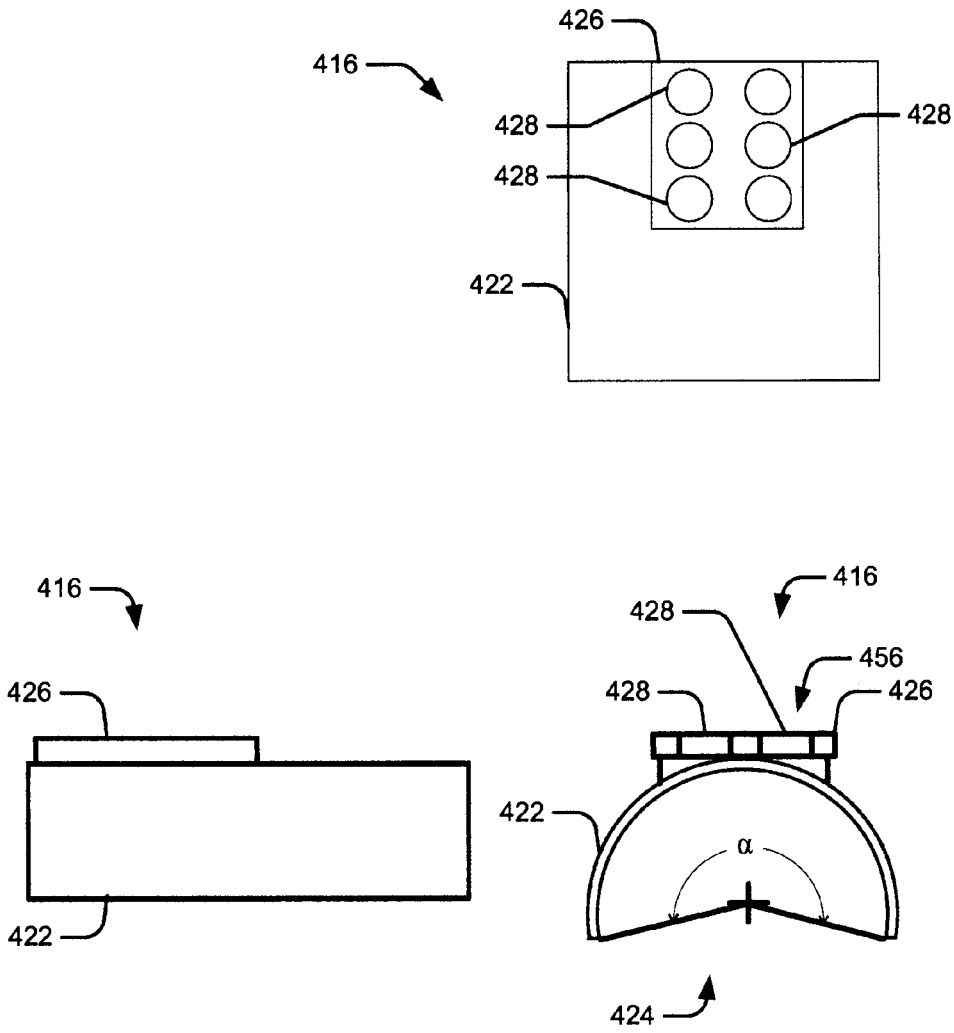
FIG. 13 illustrates an accessory adaptor.

FIG. 13 illustrates an accessory adaptor. The accessory adaptor 416 of the current embodiment further comprises the accessory retainer 422 and the magnet assembly 426. With regard to the accessory retainer 422, in cross-section, it can be an arcuate shape and more specifically, it can define a semicircle or other portion of a circle. The accessory retainer 422 therefore defines the accessory cavity 424 in its interior into which the accessory 414 can be placed for retention by the accessory retainer 422. In some embodiments, the accessory retainer 422 spans an angle a of slightly more than 180 degrees so that as an accessory 414 defining a circular cross-section is pressed into the accessory cavity 424 the opposing arms of the accessory retainer 422 spread to accept the accessory 414. Because the accessory retainer 422 can be made of a resilient material, the opposing arms thereof can close behind and retain the accessory 414 therein. In addition, or in the alternative, the accessory retainer 422 is mechanically coupled to or integrally formed with the magnet assembly 426.

The magnet assembly 426 includes one or more magnets 428 and, in some embodiments, holds the magnets 428 in an array or other pattern. For instance, FIG. 13 illustrates the magnet assembly 426 holding six (6) N52 neodymium magnets 428 in a 3×2 array arranged so that the longer side thereof will parallel with the longitudinal axis 402 of the barrel 412 when the accessory mount is coupled to the weapon 410 as shown in FIG. 11. Moreover, the magnet assembly 426 (as will be disclosed further herein) can have a length l1 (in a direction parallel to the longitudinal axis 402 of the barrel 412) about equal to that of the Picattiny rail although it need not. It might now be helpful to further consider the weapon adaptor 418 of the current embodiment.

Figure 14:
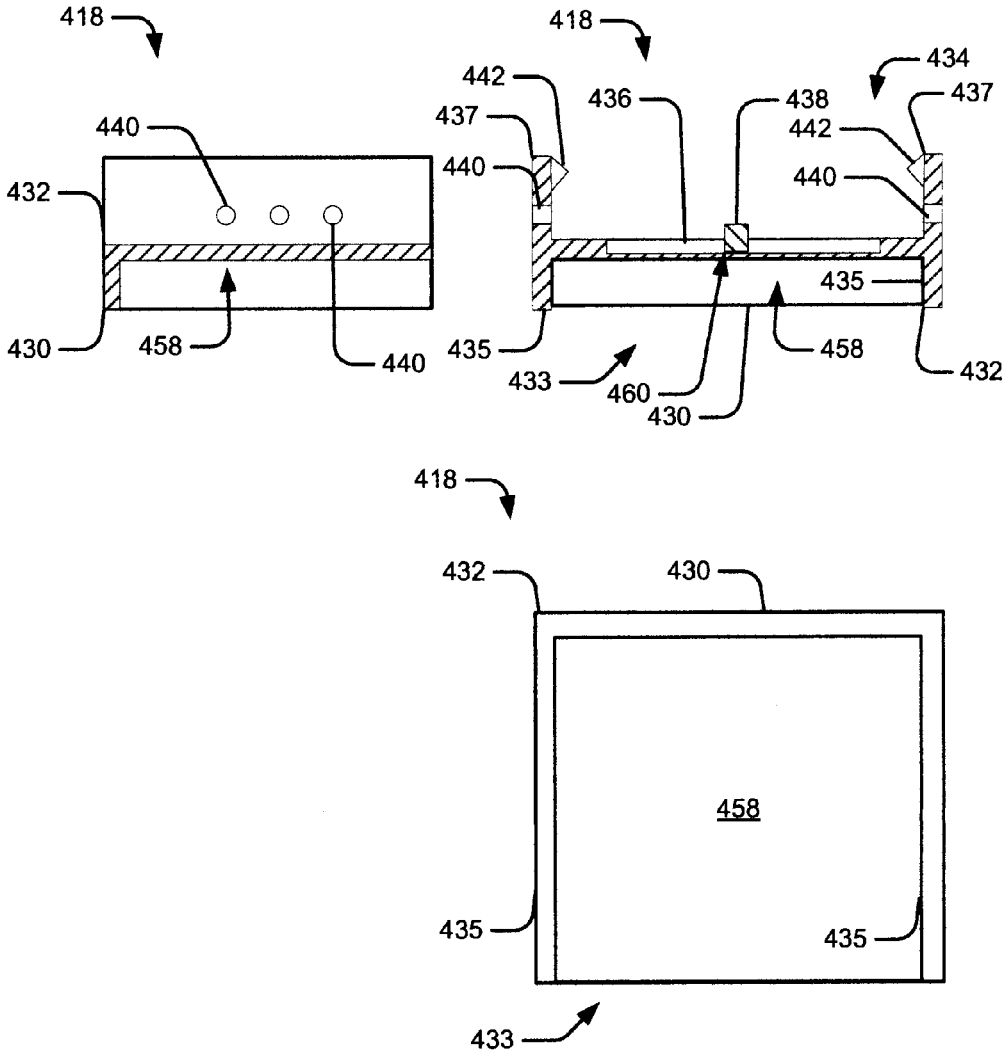
FIG. 14. Illustrates a weapon adaptor.

FIG. 14. Illustrates a weapon adaptor. More specifically, FIG. 14 illustrates a pair of cross sectional views (one lengthwise and one widthwise) and a bottom plan view of the weapon adaptor 418 of the current embodiment. It comprises the detent 430, the adaptor body 432, the magnet plate 436, the magnet 438, and the rail detents 442. Moreover, the weapon adaptor 418 (and/or its component parts) defines attachment cavity 433, the rail cavity 434 and the pin apertures 440 (for the positioning pin 420). Furthermore, the weapon adaptor 418 couples with the weapon 410 and, in some embodiments, the Picatinny rail 444 thereof. It also couples magnetically with the accessory adaptor 416 to releasably attach the accessory 414 to the weapon 410.

With continuing reference to FIG. 14, the weapon adaptor 418 comprises the generally "H" shaped adaptor body 432 (as seen in cross section looking in a longitudinal direction). Viewed from below, the weapon adaptor 418 defines the attachment cavity 433 for receiving and/or releasing and magnetically coupling with the accessory retainer 416. Thus, the attachment cavity can be shaped and dimensioned in a manner corresponding to the magnet assembly 426 of the accessory adaptor 416 of embodiments. Note that while FIG. 14 does not show any means of mechanically attaching the weapon adaptor 418 to the accessory adaptor 416 such mechanical aids could be included if desired. In addition, or in the alternative, the weapon adaptor 418 can include the detent 430 that serves to stop the accessory adaptor 416 from moving in a longitudinal direction relative to the weapon adaptor 418 while the accessory adaptor 416 is in the attachment cavity 433. Note that while FIG. 14 only shows the one detent 430, another detent 430 could be provided opposite the first one to further restrict the relative movement of these components. Additionally, FIG. 14 illustrates that the two lower "legs" 435 of the "H" shaped adaptor body 432 can also serve as weapon detents to prevent relative motion transverse to the longitudinal direction between these components.

In the upper half of the "H" shaped weapon adaptor 418, FIG. 14 illustrates the pair of opposing rail detents 442 pointed in toward the middle of the weapon adaptor 418 from the upper "arms" 437 of the adaptor body 432. In some embodiments, these rail detents are shaped, dimensioned, positioned, and/or are otherwise configured to engage the longitudinal grooves 448 on either side of common Picatinny rail 444. Thus, the weapon adaptor 418 can be positioned in front of the barrel 412 of the weapon 410 and slid onto the Picatinny rail 444 thereof with (the sides of) the rail cavity 434 and the rail detents 442 slidably engaging the Picatinny rail 444 until the weapon adaptor 418 is at some desired position thereon. By engaging the longitudinal grooves 448 of the Picattiny rail 444, the rail detents 442 (along with the positioning pin 420) serve to mechanically attach the weapon adaptor 418 to the weapon 410. As such, the rail detents 442 can be deemed a "mechanical attachment point". Although, the practice of the current disclosure can be accomplished with other types of attachment points.

It can be noted that the weapon adaptor 418 also defines one or more (in the current embodiment three) of the pin apertures 440. These pin apertures can be located on the upper arms 437 of the adaptor body 432 and can be spaced apart by the center-to-center pitch of the Picatinny rail slots 446 on the weapon 410. Moreover, the pin apertures 440 can be positioned on the upper arms 437 of the gun adaptor 418 at positions corresponding to the rail slots 446 of the Picatinny rail 444 when the gun adaptor is positioned thereon). Thus, with the weapon adaptor 418 slidably engaging the Picatinny rail 444 of the weapon 410, a user can adjust the relative positions of the weapon 410 and the weapon adaptor 418 until one of the pin apertures 440 aligns with a selected rail slot 446. The user can then place the positioning pin 420 in that pin aperture 440 such that the positioning pin 420 extends across the width of the weapon adaptor 418 (and such that it engages the walls of that rail slot 446). In some embodiments, a screw or other fastener is used in lieu of the positioning pin.

Accordingly, with the positioning pin 420 in the pin aperture(s), the weapon 410 and the weapon adaptor 418 cannot move relative to one another in a longitudinal direction. Moreover, if the positioning pin 420 is made from a magnetic (or even ferromagnetic) material, the adaptor magnet 438 can magnetically couple therewith. Note that the magnet 438 could be positioned relative to one or more pairs of the pin apertures 440 to facilitate this magnetic engagement, thereby helping to retain the positioning pin 420 in the weapon adaptor 418. Also, if desired, the adaptor magnet 438 could be one magnet shaped and dimensioned to span the distance between the most distant pairs of pin apertures 440 or it can be one of several magnets each potentially corresponding in location with a pair of pin apertures 440. Furthermore, by guiding the magnetic flux emanating from the adaptor magnet 438, the magnet plate 436 (if made from a conductive material) can also facilitate the magnetic coupling of the magnet 438 and the positioning pin 420. To this end, and perhaps others, the magnet 438 can be positioned centrally with respect to the magnet plate 436.

Figure 15:
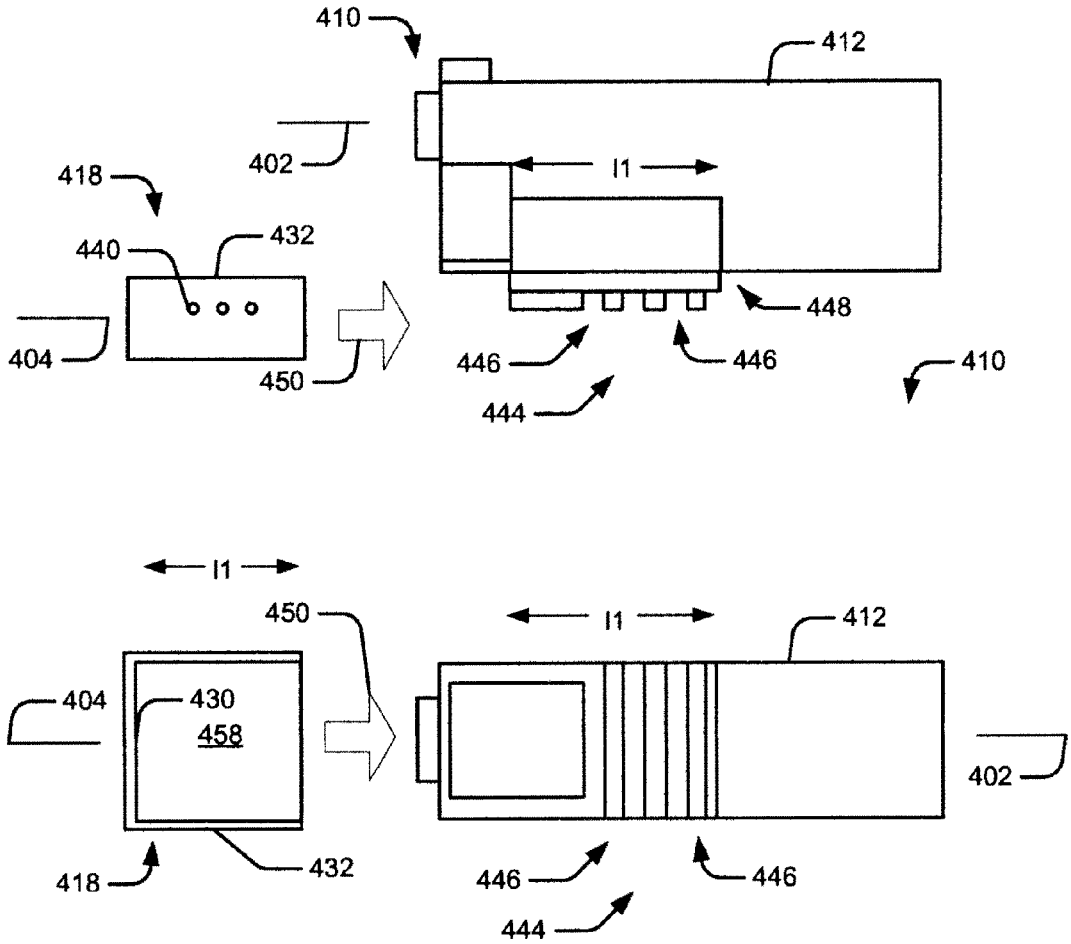
FIG. 15 illustrates assembly views of a weapon and a weapon adaptor.

FIG. 15 illustrates assembly views of a weapon and a weapon adaptor. More specifically, FIG. 15 illustrates the weapon adaptor 418 being positioned near and in front of the barrel 412 (and hence Picatinny rail 444) of a weapon 410. Arrow 450 illustrates that the weapon adaptor 418 can be brought into contact with the Picatinny rail 444 and then slid onto the weapon 410 if desired. Thus, in the current embodiment, the weapon adaptor 418 would fit underneath the barrel 412 of the weapon. It could also be aligned there with if the weapon adaptor 418 is manufactured such that its longitudinal axis 404 corresponds with the longitudinal axis 402 of the barrel 412 (when the two are engaged).

Figure 16:
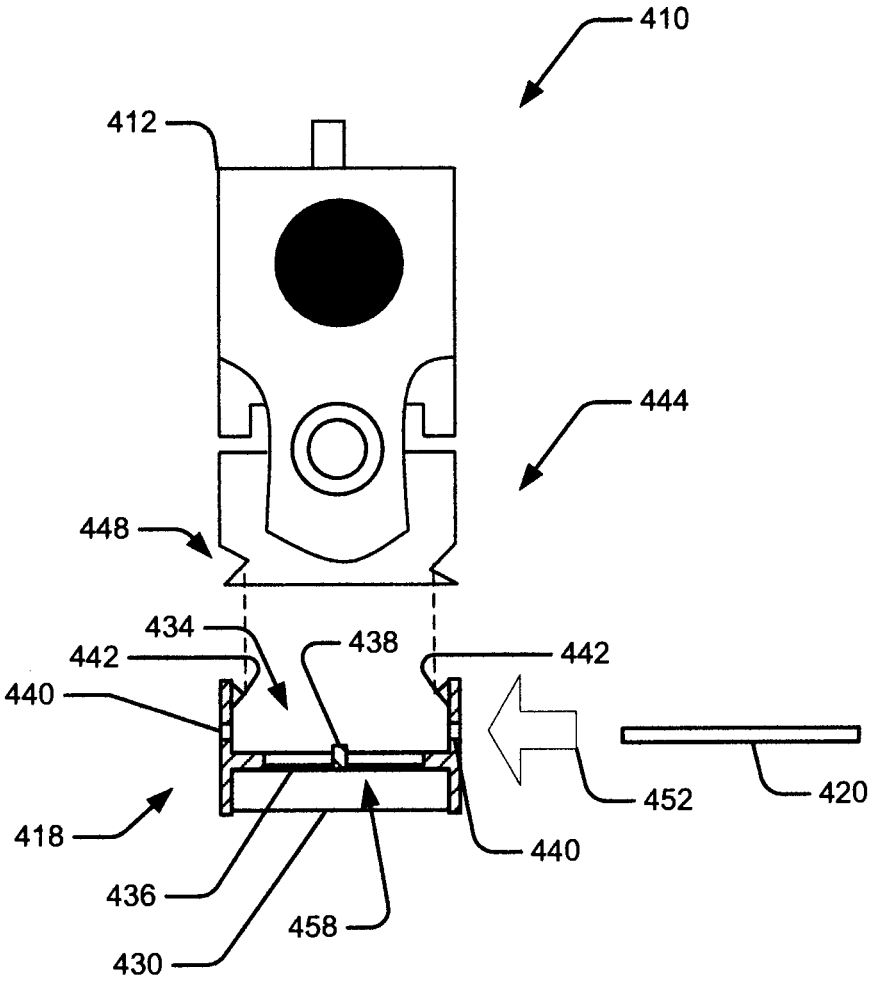
FIG. 16 illustrates another assembly view of a weapon and a weapon adaptor.

FIG. 16 illustrates another assembly view of a weapon and a weapon adaptor. FIG. 16 also shows positioning pin 420 being brought into sliding engagement with the pin apertures 440 (or rather their sides) via arrow 452. In FIG. 16, of course, the positioning pin 420 is shown as being about to slideably engage the sides of one of the rail slots 446 (not shown in FIG. 16) as it moves through a pair of opposed pin apertures 440 (with the gun adaptor 418 being engaged with the Picatinny rail 444). Note that by selecting the tolerance(s) (or lack thereof) between the gun adaptor 418 and the Picatinny rail 444, users can select how much (if any) transverse movement between these components will exist when they mate with one another.

Figure 17:
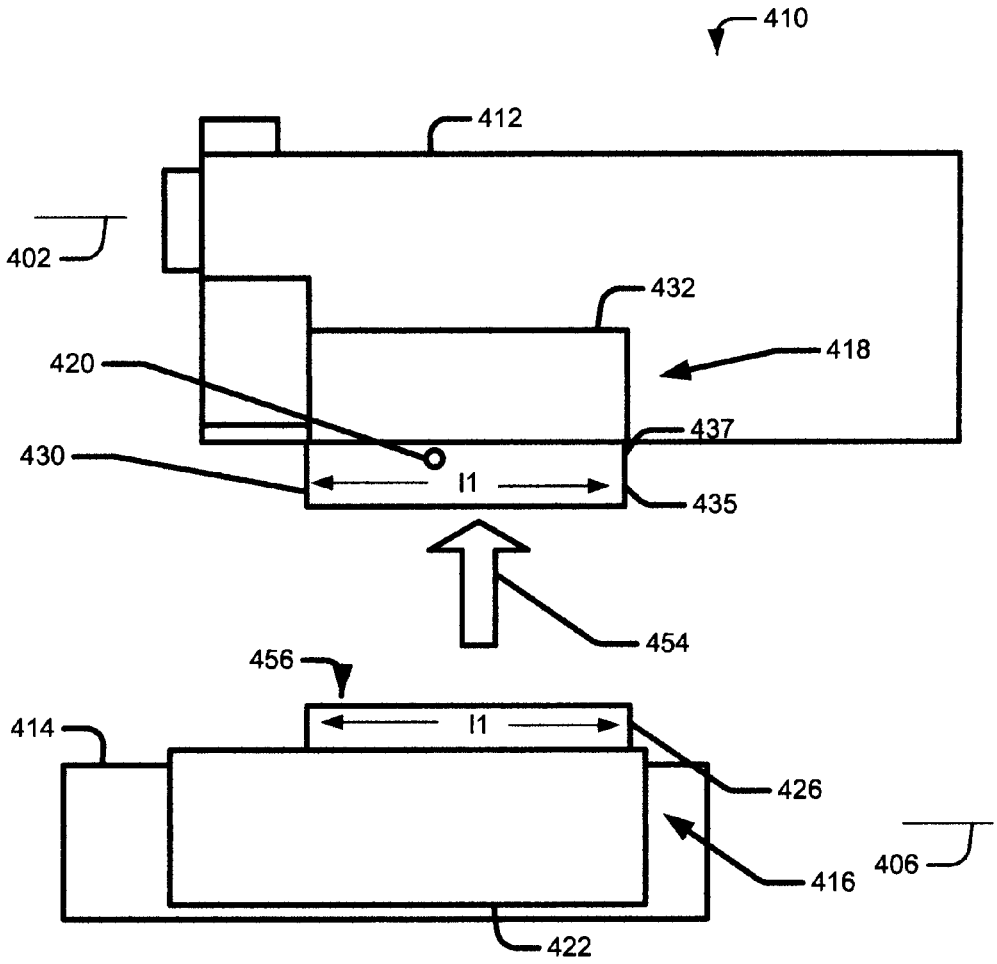
FIG. 17 illustrates an assembly view of an accessory mount.

FIG. 17 illustrates an assembly view of an accessory mount. FIG. 17 illustrates the weapon adaptor 418 as engaging the Picattiny rail 444 and being securely positioned relative thereto by positioning pin 420. Moreover, FIG. 17 illustrates the accessory 414 as being retained by the accessory adaptor 416. Thus, a user can bring the accessory adaptor 416 (with the accessory 414 therein if desired) into relatively close proximity to the weapon adaptor 418. Indeed, the user can align the magnet assembly 426 with the attachment cavity 433 of the weapon adaptor 418 and insert the accessory adaptor 416 therein as illustrated by arrow 454. As this occurs, the magnets 428 of the magnet assembly (of the accessory adaptor 416) will magnetically couple with the magnet plate 436 and or the magnet 438 (of the weapon adaptor 418). Note that in this regard, the magnet plate 436 of the weapon adaptor 418 can act as a magnetic flux guide thereby strengthening the magnetic coupling between the accessory adaptor 416 and the weapon adaptor 418. Moreover, one or both of the adaptors 416 and 418 can be configured to create an air gap between the magnets 428 and 438 (and/or the magnet plate 438) to strengthen the magnetic coupling there between if desired. Indeed, that air gap can be ensured by a tin strip of non-conductive material being positioned between the magnets 428 and 438. See FIG. 14. However, neither magnet plates 436, their action as flux guides, nor air gaps 460 are necessary for the practice of the current disclosure.

Moreover, FIG. 17 also illustrates that the weapon adaptor 418 and the accessory adaptor 416 can correspond to each other at the location(s) where they abut. For instance, both adaptors 416 and 418 can define respectively planar surfaces 456 and 458 which abut when these two portions of the accessory mount 400 of the current embodiment are magnetically coupled with each other. Moreover, while not required for the practice of the current disclosure, they can share the length l1 of the Picatinny rail 444 when viewed from the side. See FIGS. 17 and 18.

Figure 18:
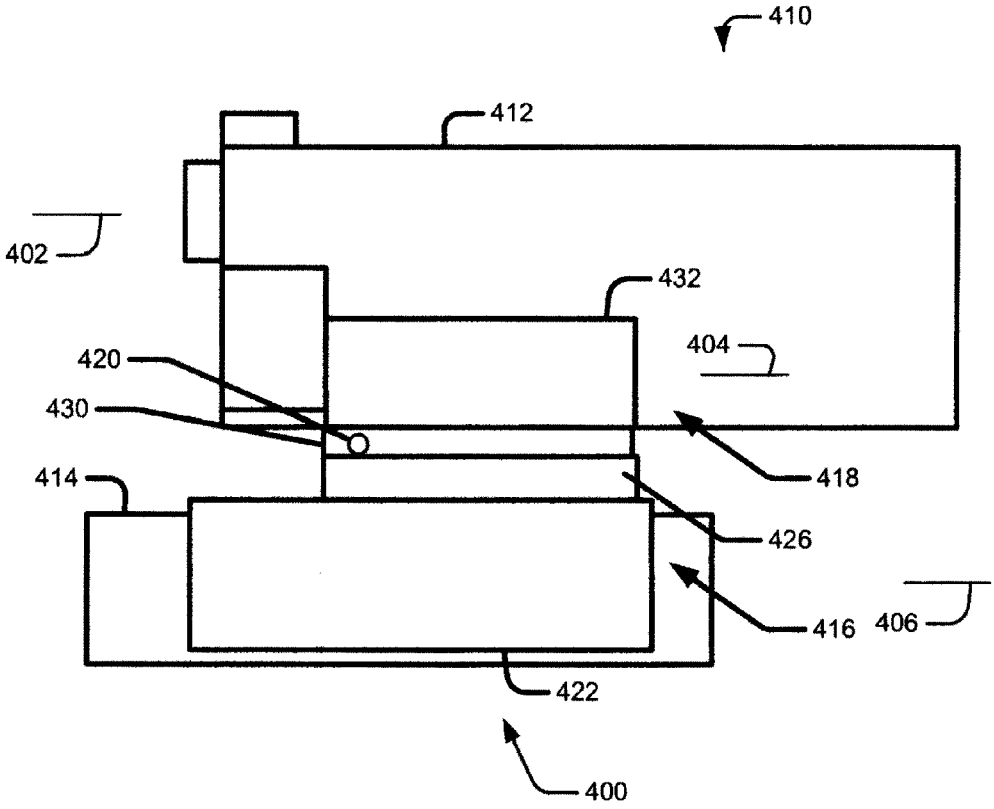
FIG. 18 illustrates a side elevation view of a weapon and an accessory mount.

FIG. 18 illustrates a side elevation view of a weapon and an accessory mount. More specifically, FIG. 18 shows the accessory adaptor 416 at least partially in the attachment cavity 433 (not visible in FIG. 18) and magnetically coupled with the weapon adaptor 418. However, in some embodiments, the weapon adaptor 418 has neither the lower legs 435 not the detent 430 and therefore does not define an attachment cavity 433 per se. In such embodiments, the accessory adaptor 416 can magnetically couple with the weapon adaptor 416 via its magnet assembly 426 and magnet 438 and/or magnet plate 436 of the weapon adaptor 418. Note also that FIG. 18 illustrates the weapon adaptor 418 being locked securely to the Picatinny rail 444 via positioning pin 420.

Thus, if desired, the weapon adaptor 418 and accessory adaptor 416 can be configured such that their respective longitudinal axes 404 and 406 are parallel to the longitudinal axis 402 of the weapon 410 (or rather the longitudinal axis 402 of the barrel 412). Accordingly, users can leave the weapon adaptor 418 attached to the barrel 412 of the weapon 410 for relatively long periods with no accessory 414 or accessory mount 416 coupled thereto. When desired, users can relatively quickly slide the accessory adaptor 416 into the attachment cavity 433 of the weapon adaptor 418 thereby magnetically coupling the two together. If the accessory adaptor 416 happens to be holding an accessory 414 at the time, then the accessory 414 can not only be coupled to the weapon 410 as a result, it can also be aligned there with. If the accessory adaptor 416 had no accessory 414 therein, the user can quickly insert the accessory 414 into the accessory cavity 424 thereby coupling (and/or aligning) the accessory 414 with the weapon 410. Moreover, the user can do so without screws, fasteners, clamps, tools, etc.

With continuing reference to FIGS. 11-18, some embodiments provide accessory mounts 400 MIL-STD-1913 dimensions (and more specifically the slot-spacing requirements as reflected in the spacing of the pin apertures 440). Embodiments, though, can accommodate other rail configurations such as those described with reference to STANAG 2324 rail. Moreover, embodiments provide weapon adaptors suitable for use with any tactical rail or bracket used with various weapons 410 to provide mounting arrangements for accessories and/or other attachments. For instance, some embodiments provide weapon adaptors configured to mate with "Weaver rail mounts." Embodiments therefore provide accessory mounts for use with tactical pistols, tactical rifles, etc. With further regard to the MIL-STD-1913 related embodiments, the weapon adaptor 418 can correspond in shapes and dimensions to a longitudinal groove 448 with an overall height of about 0.120 inches. The rail slots 446 and pin apertures 440 can be spaced apart by about 0.1575 inches and there can be three (3) pairs of the pin apertures 440. Moreover, the length l1 can reflect a Picatinny rail 444 length l1 of about 1.643 inches.

Moreover, the planar surfaces 456 and 458 (of respectively the accessory adaptor 416 and the weapon adaptor 418) allow the magnetic flux from full surface area of the 6 magnets 428 to have a corresponding portion of the magnet plate 436 adjacent thereto (with or without an air gap 460). Such arrangements can increase the amount of magnetic flux captured by the magnet plate 436 and/or guided to/from the magnet 438 of the weapon adaptor 418. As a result, accessory mounts 400 of the current embodiment can optimize the amount of magnetic coupling between the adaptors 416 and 418 given the size of the accessory mount 400. Moreover, because of the strength of the magnetic field between the two adaptors 416 and 418, accessory mounts 400 of some embodiments self-center due to force imbalances that might develop should the accessory adaptor 416 and weapon adaptor 418 not completely register with each other.

In some scenarios, the weapon adaptor 418 can be left on the weapon 410 (and held in place by the positioning pin 420) for relatively long periods of time. Furthermore, the positioning pin 420 can be held in place by the magnet 438 which can be embedded in the (injection molded ABS plastic of the) body 432 of the weapon adaptor 418 of the current embodiment. Thus, no screws or other fasteners need be used to hold the weapon adaptor 418 of embodiments on the Picatinny rail 444. Moreover, the magnet 438 of the weapon adaptor 418 can be two or more magnets such as ⅜ by ⅛ inch N52 Neodymium magnets.

The accessory adaptor 416 of the current embodiment can, of course, hold the accessory (for instance a flash light). It can slide upward into the attachment cavity of the weapon adaptor 418 where it can be held in place by magnetic force developed between itself and the weapon adaptor 418. Moreover, it too can be made from injection molded ABS plastic and can have embedded therein six (6) ⅜ inches by ⅛ inch N52 Neodymium disk magnets 428. The number of such magnets can vary between embodiments some of which include eight (8) such magnets 428.

Note that, while certain terms have been used herein which might convey some sense of direction, these terms are not intended to be limiting. They have been used, instead, as a matter of convenience. For instance, terms such as "above," "below," "longitudinal," etc. have been used to disclose certain aspects of embodiments and do not imply that apparatus, mounts, assemblies, adaptors, etc. need be in a particular orientation to practice the embodiments disclosed herein.

Conclusion

Although the subject matter has been disclosed in language specific to structural features and/or methodological acts, it is to be understood that the subject matter defined in the appended claims is not necessarily limited to the specific features or acts disclosed above. Rather, the specific features and acts disclosed above are disclosed as non-limiting forms of implementing the claimed subject matter.

What is claimed is:

1. An apparatus for releasably attaching an accessory to a gun which includes a barrel, the apparatus comprising:

a gun assembly further comprising a first body defining a mechanical attachment point shaped and dimensioned to mate with the barrel of the gun and a magnet mechanically coupled to the mechanical attachment point;

an accessory assembly further comprising a second body defining a retention cavity shaped and dimensioned to receive the accessory and defining a detent being shaped and dimensioned to retain the accessory in the retention cavity and a second magnet coupled to the second body, the first and the second magnets being positioned on respectively the first and second bodies such that when the first and second bodies abut each other the first and second magnets magnetically couple with each other with sufficient strength to withstand a shock associated with the barrel of the gun during the firing of the gun thereby releasably attaching the accessory assembly to the gun via the gun assembly;

a locking pin of the gun assembly, the locking pin being shaped and dimensioned to lock the gun assembly at a user selected position on the gun; and a third magnet of the gun assembly, the locking pin being made of a ferromagnetic material, the third magnet and the locking pin being positioned relative to each and being configured to magnetically couple with each other with sufficient strength to withstand the shock associated with the barrel of the gun during the firing of the gun thereby retaining the locking pin in the gun assembly, wherein the first and second bodies define respectively first and second generally planar surfaces such that when the first and second bodies abut each other the first and second magnets couple with each other across the first and second planar surfaces.

2. An apparatus comprising:

a gun assembly further comprising a first body defining an attachment point adapted to mate with a gun barrel and a magnet coupled to the attachment point; and an accessory assembly further comprising a second body defining a cavity adapted to receive the accessory and a detent adapted to retain the accessory in the cavity and a second magnet coupled to the second body, the magnets being positioned on the respective bodies such that when the bodies abut each other the magnets magnetically couple with each other with sufficient strength to withstand a firing shock of the gun associated with the barrel to thereby releasably attach the accessory assembly to the gun via the gun assembly.

3. The apparatus of claim 2 wherein the attachment point is further adapted to mate with a Picattiny rail.

4. The apparatus of claim 3 wherein the first and second bodies define first and second longitudinal axes respectively and wherein the first and second bodies define abutting surfaces that are approximately 1.643 inches in length in a direction parallel to the respective longitudinal axes.

5. The apparatus of claim 3 further comprising a positioning pin of the gun assembly, the positioning pin being adapted to lock the gun assembly at a user selected position on the Picatinny rail.

6. The apparatus of claim 5 further comprising a third magnet of the gun assembly, the positioning pin being made of a ferromagnetic or magnetic material, the third magnet and the positioning pin being positioned relative to each and being configured to magnetically couple with each other with sufficient strength to withstand the firing shock to thereby retain the positioning pin in the gun assembly.

7. The apparatus of claim 6 wherein the positioning pin is a ferromagnetic component.

8. The apparatus of claim 7 wherein the first and second bodies respectively define first and second generally planar surfaces such that when the first and second bodies abut each other the first and second magnets couple with each other across the first and second planar surfaces.

9. The apparatus of claim 2 wherein the accessory is a light producing device.

10. The apparatus of claim 2 wherein the first and second bodies are adapted to align the accessory with a longitudinal axis of the barrel of the gun when the accessory is retained by the second body and the first and second bodies abut each other and when the attachment point is mated with the barrel of the gun.

11. The apparatus of claim 2 wherein the second magnet is one of a plurality of magnets coupled to the second body.

12. A mount for releasably mounting accessories to guns which include barrels, the mount comprising:

a gun adaptor further comprising a first body defining a mechanical attachment point shaped and dimensioned to mate with the barrel of the gun and a magnet mechanically coupled to the mechanical attachment point; and an accessory adaptor further comprising a second body defining a retention cavity shaped and dimensioned to receive the accessory and a detent being shaped and dimensioned to retain the accessory in the retention cavity and a second magnet coupled to the second body, the first and the second magnets being positioned on respectively the first and second bodies such that with the first and second bodies abutting each other the first and second magnets magnetically couple with each other with sufficient strength to withstand a shock associated with the barrel of the gun during the firing of the gun to thereby releasably attach the accessory adaptor to the gun via the gun adaptor.

13. The apparatus of claim 12 wherein the mechanical attachment point is further shaped and dimensioned to mate with a Picattiny rail.

14. The apparatus of claim 13 wherein the first and second bodies define first and second longitudinal axes respectively and wherein the first and second bodies define abutting surfaces that are approximately 1.643 inches in length in a direction parallel to the respective longitudinal axes.

15. The apparatus of claim 13 further comprising a positioning pin of the gun adaptor, the positioning pin being shaped and dimensioned to lock the gun adaptor at a user selected position on the Picatinny rail.

16. The apparatus of claim 15 further comprising a third magnet of the gun adaptor, the positioning pin being made of a ferromagnetic or magnetic material, the third magnet and the positioning pin being positioned relative to each and being configured to magnetically couple with each other with sufficient strength to withstand the shock associated with the barrel of the gun during the firing of the gun to thereby retain the positioning pin in the gun adaptor.

17. The apparatus of claim 16 wherein the positioning pin is a ferromagnetic component.

18. The apparatus of claim 12 wherein the first and second bodies respectively define first and second generally planar surfaces such that with the first and second bodies abutting each other the first and second magnets couple with each other across the first and second planar surfaces.

19. The apparatus of claim 12 wherein the accessory is a light producing device.

20. The apparatus of claim 12 wherein the first and second bodies are shaped and dimensioned to align the accessory with a longitudinal axis of the barrel of the gun when the accessory is retained by the second body and the first and second bodies abut each other and the mechanical attachment point is mated with the barrel.

* * * * *